United States Patent [19]

Strongwater

[11] Patent Number: 4,975,986

[45] **Date of Patent: * Dec. 11, 1990**

[54] MEANS FOR REMOVABLY SECURING ACCESSORIES TO WEARING APPAREL AND THE LIKE

[76] Inventor: Murray Strongwater, 326 Hewlett Neck Rd., Woodmere, N.Y. 11598

[ * ] Notice: The portion of the term of this patent subsequent to Jul. 18, 2006 has been disclaimed.

[21] Appl. No.: 372,542

[22] Filed: Jun. 28, 1989

Related U.S. Application Data

[63] Continuation of Ser. No. 245,744, Sep. 6, 1988, Pat. No. 4,847,917.

[51] Int. Cl.[5] ..... A41D 19/00; A41D 27/08

[52] U.S. Cl. ..... 2/160; 2/162; 2/244; 2/265

[58] Field of Search ..... 2/160, 244, 245, 246, 2/265, 239, 242, 74

[56] References Cited

U.S. PATENT DOCUMENTS

| | | | |
|---|---|---|---|
| 2,391,429 | 12/1945 | Lipari | 2/245 |
| 2,748,517 | 6/1956 | Berkis | 41/34 |
| 2,829,416 | 4/1958 | Sam | 24/217 |
| 4,068,322 | 1/1978 | Rathel | 2/239 |
| 4,847,917 | 7/1989 | Strongwater | 2/160 |

*Primary Examiner*—Werner H. Schroeder
*Assistant Examiner*—Gloria Hale
*Attorney, Agent, or Firm*—Henry R. Lerner

[57] ABSTRACT

An article of wearing apparel adapted to have releasably secured thereto an ornamental element. There is provided fastener means having a pair of complementary fastener portions adapted to be selectively engageable or disengageable for securing or releasing said fastener portions, respectively. One of said fastener portions is secured to the inside of said article of wearing apparel and the other of said fastener portions is adapted to be secured to said ornamental element. In this way any selected one of a plurality of ornamental elements provided with said other of said fastener portions is adapted to be releasably secured to the article of wearing apparel to form a combination which simulates an article of wearing apparel having an ornamental element permanently secured thereto by stitching. Instead of an article of wearing apparel there may be provided an accessory, such as a pocketbook, to the inner surface of which there is secured a fastener portion so that an ornamental element may easily be secured thereto.

9 Claims, 4 Drawing Sheets

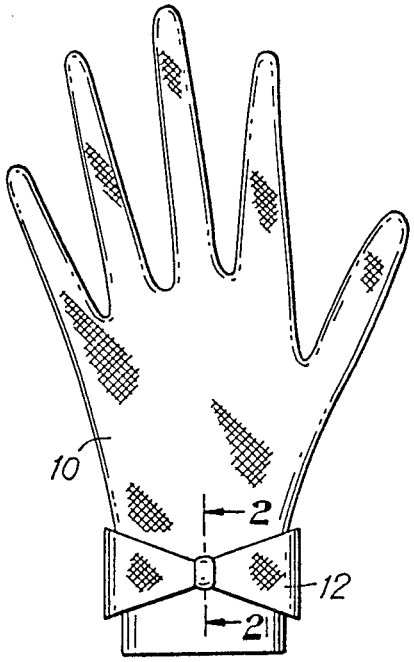
FIG. 1
PRIOR ART
FIG. 2
PRIOR ART
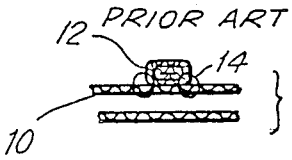
FIG. 3
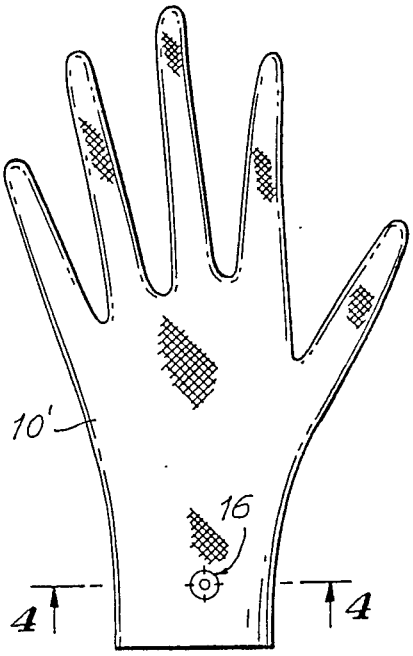
FIG. 4
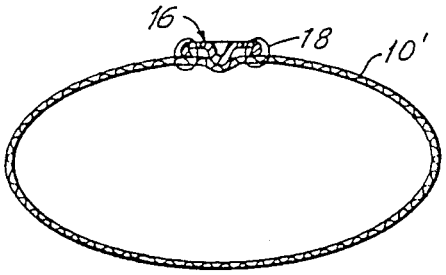

FIG. 10
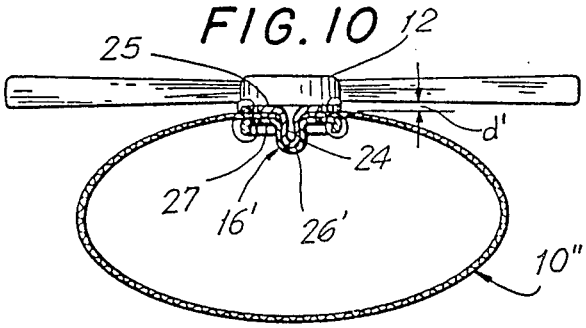
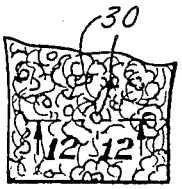
FIG. 11
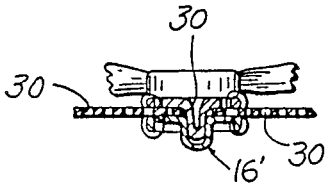
FIG. 12
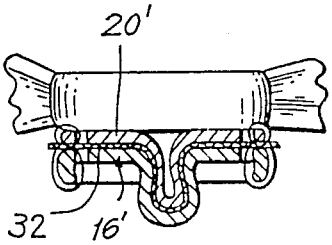
FIG. 13

FIG. 14
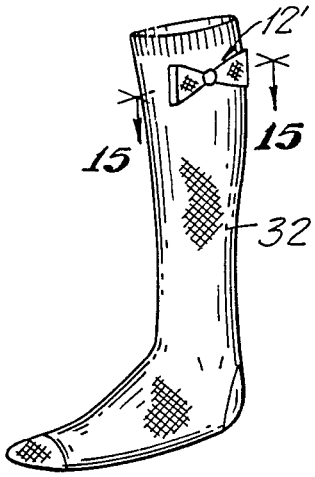
FIG. 15
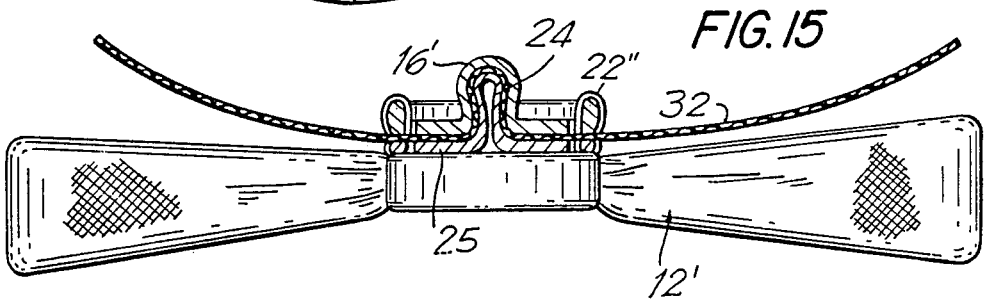
FIG. 16
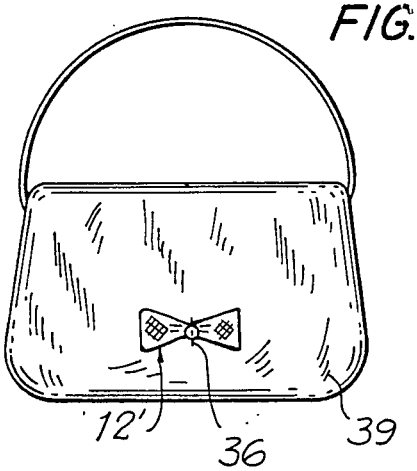
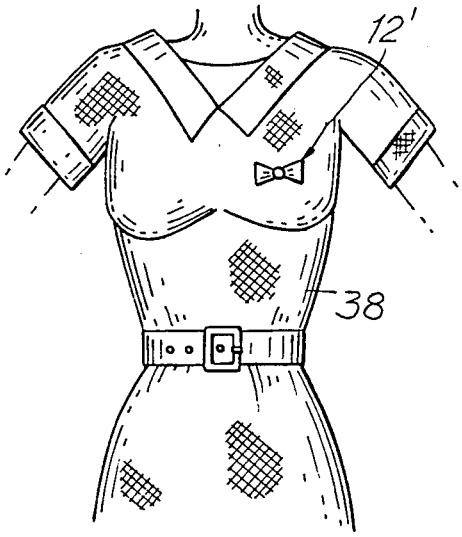
FIG. 17

MEANS FOR REMOVABLY SECURING ACCESSORIES TO WEARING APPAREL AND THE LIKE

RELATED APPLICATION

This is a continuation in part of application Ser. No. 245,744 filed Sept. 6, 1988, now U.S. Pat. No. 4,847,917 issued on July 18, 1989.

BACKGROUND AND BRIEF DESCRIPTION OF THE INVENTION

Women's gloves are often provided with ornamental elements or accessories such as bows, flowers, which cooperate with and complement the rest of the glove in order to impart an overall attractive look for the wearer.

An example of a glove provided with an ornamental element, such as a bow, is shown in my prior U.S. Pat. No. 4,757,558. In this patent, however, the ornamental element becomes a permanent part of the glove so that the wearer is compelled, if she decides to wear a particular pair of gloves, to include the particular ornamental accessory which is a permanent part of the glove even though this may not match the rest of the wearer's apparel.

It is therefore a principal object of the invention to provide a fashion glove which is adapted to receive any one of a plurality of ornamental elements but which looks as if the accessory is permanently stitched onto the glove. In accordance with one embodiment of the invention, the glove and the decorative element are provided with complementary fastening elements which are releasable so that the decorative element is removably secured to the glove. In accordance with such preferred embodiment, the fastener combination which is used is a conventional snap fastener comprising cooperating male and female snap portions. One of these snap portions is secured onto the glove, while the other snap portion is secured to the decorative element. The decorative element is easily secured onto the glove by the cooperating snapping action of the respective male and female snap portions.

While the use of cooperating male and female snap portions on the glove and the decorative element, respectively, permits the use of a plurality of decorative elements with a single pair of gloves, there are also some negative effects due to the metal to metal or plastic to plastic contact between male and female snap portions which impart to the decorative element a tendency to rotate about the glove and therefore assume unattractive and undesirable positions relative to the glove. For example, in the case of a bow, it is obviously intended that the bow extend laterally of the wearer's hand and not longitudinally thereof. With the use of conventional male and female snap portions, on the ornamental element and the glove, respectively, the snap portions are in physical engagement with each other resulting in metal to metal contact wherein the snap portion on the glove provides, in effect, a bearing for the snap portion on the ornamental element, creating the aforementioned tendency of the ornamental element to rotate in response to the slightest movement of the hand or in response to the inadvertent contact of the ornamental element with another object.

It is important to note that the object to be achieved is the duplication, to the extent possible, of the appearance of a glove to which an ornamental element has been permanently fastened, as by stitching. This visual impression is not possible with the conventional use of male and female snap portions wherein the snap portions are sewed on the outer surfaces of the glove and decorative elements, respectively, causing the ornamental element to be spaced from the glove by the combined thicknesses of the engaged male and female snap portions. This results in an aesthetically unacceptable arrangement with the ornamental element being raised substantially above the surface of the glove proper.

The duplication of the appearance of a permanently attached ornamental accessory to the glove requires the use of an accessory which appears to be firmly attached onto the glove, without any spacing between the accessory and the glove, and also requires that the ornamental element does not tilt or swing out of position. The use of snap fastener elements, in the conventional manner, as pointed out above, does not produce an arrangement which visually duplicates the desired look of a permanently attached accessory onto the glove.

The securing of an accessory to a glove is crucial to its appearance. Highly skilled sewing machine operators on special type machines, or highly skilled hand sewers are required to do the tedious work of securing the ornamental accessory onto the glove properly.

Thus the primary object of the invention is to provide means for permitting the use of any selected one of a plurality of ornamental accessories with a single glove, by using a snap fastener arrangement, but without the accompanying drawbacks of having the ornamental element spaced a significant amount from the surface of the glove proper, and with a tendency to pivot about the snap at the slightest provocation.

In accordance with the invention, the snap fastener portion provided on the glove is the female snap portion which is secured to the inner side of the glove rather than to the outer side thereof and the complementary male snap portion is stitched onto the ornamental element. Thus, when the glove is worn without any accessory, the snap portion on the glove is inside the glove and hardly visible. The glove is provided with a slit which confronts the cavity of the female snap portion so that the projection of the male snap fastener portion can be inserted into the female snap portion cavity in order to snap therein and complete the fastening operation. The edges of the slit are preferably finished off as in a button hole, in order to prevent any unraveling of the material of the glove. When the ornamental element, which is provided with the male snap portion, is snapped into the female snap portion on the inside of the glove, with the projection passing through the slit and engaging the cavity, the glove material is trapped between the confronting surfaces of the respective snap elements to avoid a metal to metal contact between these two surfaces and thus provide friction between the two snap portions to minimize the tendency of one to rotate with respect to the other. In addition, because the female snap fastener element is secured to the inner side of the glove the ornamental element is not spaced from the glove by an amount equal to the thickness of the female snap portion. Since the female snap portion of a snap fastener arrangement is approximately three times the thickness of a male fastener element the result of the arrangement in accordance with the invention is to create the appearance of having the ornamental element secured, as by stitching, directly onto the glove, while at the same time having the capacity to be interchangeably used with different ornamental elements or accessories.

Where the glove fabric is provided with natural holes or openings, as is the case with lace, no slits are necessary since the projecting element of the male snap fastener portion can easily be snapped into the female cavity by passing through one of the natural openings in the fabric and all the advantages of this arrangement are preserved.

Where the glove fabric is very sheer, no slit is necessary, as a proper snap fastener element can be selected in which the male and female snap portions can be snapped together with the sheer material captive therebetween. In this arrangement, again, the ornamental element is constrained from pivotal movement by the friction between the captive material and the confronting surfaces, and the ornamental element also appears to be close to the surface of the glove, as is the case in a permanently secured ornamental element.

It is also an object of the invention to provide means for permitting the use of any selected one of a plurality of ornamental elements with articles of wearing apparel other than gloves, as for example, hosiery, dresses, sweaters, as well as pocketbooks, and other accessories of the type to bear ornamental elements. In each case, there is provided a female snap portion which is secured to the inner side of the hosiery, dress, or handbag as the case may be, and the complementary male snap portion is secured to the ornamental element.

The above and other objects, features and advantages of the present invention will become readily apparent from the following detailed description which is to be read in conjunction with the accompanying drawings.

BRIEF DESCRIPTION OF THE DRAWINGS

FIG. 1 is a top plan view of a glove provided with an ornamental accessory, in accordance with the prior art;

FIG. 2 is a sectional view taken along line 2—2 of FIG. 1;

FIG. 3 is a top plan view of a glove provided on its outer surface with a female snap portion, for receiving any one of a plurality of decorative elements;

FIG. 4 is a sectional view taken along lines 4—4 of FIG. 3;

FIG. 10 is a view illustrating the glove of FIG. 8 with the ornamental accessory of FIGS. 4 & 5 secured thereto;

FIG. 11 is a fragmented plan view showing lace material out of which a glove can be made;

FIG. 12 is a view similar to FIG. 10 but showing a glove made of lace and provided with natural openings therein;

FIG. 13 is a view similar to Fig 12 and FIG. 10 illustrating a glove made of very sheer material to which a decorative accessory has been secured;

FIG. 14 is a side elevational view of a stocking provided with an ornamental element in accordance with the invention;

FIG. 15 is a section taken along line 15—15 of FIG. 14, on an enlarged scale;

FIG. 16 is a front elevational view of a pocketbook provided with an ornamental element in accordance with the invention; and FIG. 17 is a front elevational view of a dress provided with an ornamental element in accordance with the invention

DESCRIPTION OF THE PREFERRED EMBODIMENTS

Figure 5:
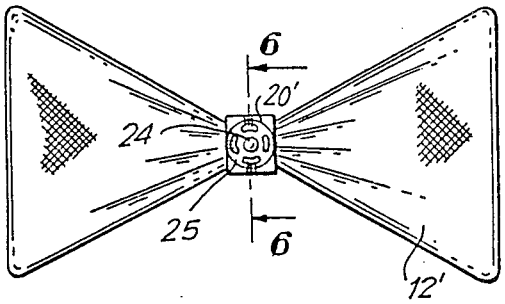
FIG. 5 is an ornamental accessory provided with a male snap portion for engagement with a female snap portion on the glove in FIGS. 3 and 4.

Referring now to the drawings, and particularly FIGS. 1 and 2 thereof, there is shown a conventional glove 10 provided with an ornamental accessory 12, which is shown typically as a bow, permanently secured to glove 10, by means of stitching 14 as shown in FIG. 2. As seen in FIG. 2, the accessory 12 is retained in permanent engagement with the glove, as desired for esthetic purposes, and the said accessory, because of the permanent stitching 14, will be substantially prevented from being rotationally or otherwise displaced from its intended orientation, namely transverse to the longitudinal direction of the glove.

It will be appreciated that while the glove of FIG. 1 is ideal in terms of maintaining the accessory in a secured desired position, the glove is not usable with any other accessory and thus has limited utilization.

Referring now to FIGS. 3 through 7 there is shown a glove 10' provided on the outer surface of the palm side thereof with female snap portion 16 which, as shown in FIG. 4, is secured to the outside of the glove by conventional stitching 18.

Figure 6:
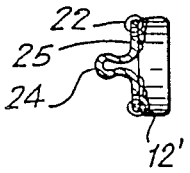
FIG. 6 is a sectional view taken along line 6—6 of FIG. 5.
Figure 7:
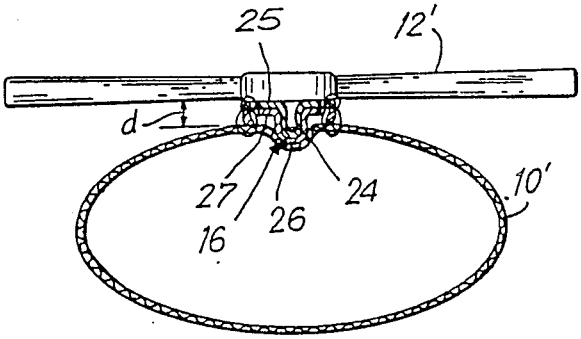
FIG. 7 is a view, partially in section illustrating the decorative accessory of FIGS. 5 and 6 secured to the glove of FIGS. 3 and 4.

Glove 10' is intended to be used in conjunction with ornamental element or accessory 12', best illustrated in FIGS. 5 and 6. Ornamental accessory 12', illustratively shown as a bow, is provided at its center knot with male snap portion 20' secured thereto by stitching 22. Male snap portion 20' is provided with a projecting member 24, adapted to be snapped into the cavity 26 of the complementary female snap portion 16 as shown in FIG. 7 wherein the decorative element 12' is secured to glove 10' by the interconnection of projecting member 24 of the male snap portion with the cavity 26 of the female snap portion. It will be noted, particularly with reference to FIG. 7 that the accessory 12' is spaced from the glove 10' a significant distance "d" which is unattractive and which clearly indicates that the accessory, namely the bow, is not permanently secured by stitching to the glove, the impression intended to be created.

Furthermore it will be noted, assuming the use of metallic snap fastener elements, male and female, that there is metal to metal engagement between the annular member 25 bounding projection 24 of the male snap portion and annular member 27 bounding cavity 26 of the female snap portion when the two are secured to each other, as shown in FIG. 7. Such metal to metal contact minimizes the amount of friction between the two fastening elements portions whereby the bow is easily displaced from its intended transverse position to one which is clearly undesirable and unsuitable for the wearer.

Thus, while the embodiment of FIG. 3 through 7 permits the free interchange of ornamental accessories with the same pair of gloves, the resulting combination leaves much to be desired, in that such combination is one in which the accessory is spaced from the glove proper a distance too great to be acceptable, and in that the accessory is easily displaced or assumes an unintended orientation. Thus the embodiment of FIGS. 3 through 7 fails to duplicate the intended impression that the decorative accessory is firmly secured to the glove as by stitching to the glove.

Figure 8:
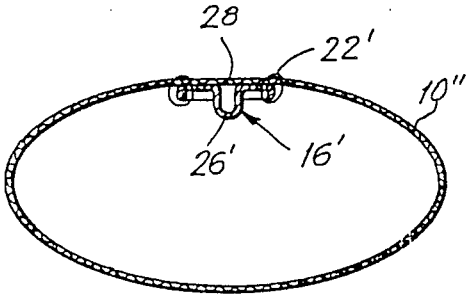
FIG. 8 is a sectional view of a glove in accordance with the preferred embodiment of the invention.
Figure 9:
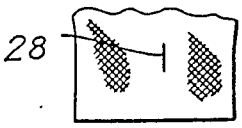
FIG. 9 is a partial top plan view of FIG. 8.

Referring now to FIGS. 8 and 9 there is shown the preferred embodiment in accordance with the invention. As shown in FIG. 8, glove 10" is provided with female snap portion 16' which, unlike the embodiment of FIG. 4, is secured to the inside of the glove 10" by means of stitching 22' or by any other conventional securing means. Further, as shown in FIG. 9, a short slit 28 is provided in the glove immediately confronting the cavity 26' of the female snap portion 16'. The glove of FIG. 8 is now able to receive, in snapping engagement, the accessory 12' of FIG. 5 as shown in FIG. 10 by the engagement of male projection 24 into the cavity 26', with the male projecting element passing through the glove fabric via slit 28. If desired, the male snap portion could be secured to the inside of glove 10" and the female snap portion to the ornamental accessory. This would, however, yield a less satisfactory arrangement as the male projection would extend through the slit and be exposed when no accessory is attached to the glove.

With further reference to FIG. 10, it will be seen that the resulting combination of accessory and glove is one wherein the accessory is nearly in contact with the glove itself because the major width of the snap fastener, namely the female snap portion 16', is located inside the glove and does not contribute to the spacing between the accessory 12' and the glove 10" itself, thus providing an appearance which simulates that of an ornamental element directly stitched onto the glove.

It will further be noticed that the material of the glove proper is captive between annular members 25 and 27 of the male and female snap portions, respectively, to eliminate metal to metal contact between the two. This provides for substantially increased friction between the male and female snap portions to, in turn, substantially minimize, if not entirely eliminate, the tendency of the ornamental element to be displaced from its intended position. In connection with this embodiment, it should be noted that in a conventional snap fastening element the width of the female snap element is nearly three times that of the male snap portion, so that "d'" in FIG. 10 is approximately one quarter of "d" in FIG. 7.

Accordingly, the feature of the present invention which comprises the securing of the female snap portion inside the glove, and under the glove fabric, provides the substantial advantage of permitting easy substitution of accessories while still retaining the impression of an accessory which is directly stitched onto the glove.

Referring now to FIG. 11 there is shown a small section of lace fabric which is often utilized as the material for the glove or for part of the glove. Such lace is provided with natural openings such as shown by numeral 30. Where a glove is provided with lace having such natural openings, it becomes unnecessary to provide a slit for the passage of the projecting member on the male snap portion since such projecting member can easily pass through one of the natural openings in the lace fabric. This is shown in FIG. 12, which is similar to FIG. 10 except only that the projecting element on the accessory passes through natural opening 30 in the glove fabric. In all other respects the embodiment of FIGS. 11 and 12 is the same as that of FIG. 10 wherein the accessory, once secured to the glove proper, is in very close proximity to the glove surface and is prevented from inadvertent rotation with respect thereto, to most satisfactorily simulate a glove having an ornamental accessory secured directly onto the glove.

FIG. 13 is a view similar to FIGS. 10 and 12 but illustrates the application of the invention where the glove is made of material 32 which is very thin or very sheer. In such eventuality, there is no natural opening nor is there any need to provide a slit in the fabric because the sheerness of the fabric makes it possible for it to be trapped in between the male and female snap portions 20' and to secure the ornamental accessory to the glove in substantially the same manner as shown in FIG. 12 and FIG. 10, without perforating the glove.

FIG. 14 shows a stocking 32 provided with ornamental element 12'. As shown in FIG. 15, stocking 32 is provided with female snap portion 16'secured to the inside of the stocking 32 by means of stitching 22". Since the stocking is made of sheer material no slit is necessary and the ornamental accessory 12' is secured to stocking 32 precisely as illustrated in FIG. 15.

FIG. 16 shows a pocketbook 34 to which is secured ornamental accessory 12, there being provided a slit 36 in the pocketbook to permit passage of the projecting member of the male fastener element secured to accessory 12'. A cross section through ornamental element 12' would look substantially as depicted in FIG. 10.

FIG. 17 illustrates a woman's dress 38 similarly provided with a female snap fastener element stitched to the inside of the fabric for receiving the male fastener element of bow 12'. If the dress is made of knit fabric, no slit is necessary and a cross section through ornamental element 12' would look substantially as depicted in FIG. 12.

It will be apparent and clear to one skilled in the art that the aforedescribed invention is applicable to a multitude of articles such as, for example, hats, scarves, hair ornaments, shoe ornaments and the like.

Having described the preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. An article of wearing apparel adapted to have releasably secured thereto an ornamental accessory comprising, (a) fastener means having a pair of complementary fastener portions adapted to be selectively engagable or disengagable for securing or releasing said fastener portions, respectively, (b) one of said fastener portions being secured to the inside of said article of wearing apparel and the other of said fastener portions being adapted to be secured to said ornamental accessory, (c) whereby any selected one of a plurality of ornamental accessories provided with said other of said fastener portions is adapted to be releasably secured to said article of wearing apparel to form a combination which simulates an article of wearing apparel having an accessory permanently secured thereto by stitching.

2. An article of wearing apparel in accordance with claim 1 wherein said fastener means comprise a snap fastener element having a male and a female portion with said male portion having a projection and said female portion having a cavity adapted to receive said projection for securing said male and female portion.

3. An article of wearing apparel in accordance with claim 2, wherein said female portion defines said one fastener portion secured to said article of wearing apparel and said male portion defines said other fastener portion adapted to be secured to said ornamental accessory.

4. An article of wearing apparel in accordance with claim 1 wherein said fastener means comprise a snap fastener element having a male and a female portion with said male portion having a projection bounded by an annular member and said female portion having a cavity bounded by an annular member, said cavity being adapted to receive said projection for securing said male and female portion.

5. An article of wearing apparel in accordance with claim 4, wherein said female portion defines said one fastener portion secured to said article of wearing apparel and said male portion defines said other fastener portion adapted to be secured to said ornamental accessory.

6. An article of wearing apparel in accordance with claim 5, wherein said female portion of the fastener means is secured to the inside of the article of wearing apparel with the annular member in engagement with the article of wearing apparel material whereby said female portion is substantially concealed from view when the article of wearing apparel is worn without ornamental accessory.

7. An article of wearing apparel in accordance with claim 6, wherein the article of wearing apparel is provided with a slit immediately confronting the cavity of the female fastener portion to permit passage of the projection on the male fastener portion for engagement in said cavity, said article of wearing apparel material being captured between said annular members to inhibit relative rotation between said annular member.

8. An article of wearing apparel in accordance with claim 6, wherein said article of wearing apparel material includes natural holes and said female portion is secured to the inside of the article of wearing apparel with one of said natural holes immediately confronting the cavity in said female fastener portion to permit passage of the projection of the male fastener portion for engagement in said cavity.

9. An article of wearing apparel in accordance with claim 8, wherein said article of wearing apparel material includes lace fabric having said natural holes.

* * * * *